US009446419B2

(12) United States Patent
Zhou et al.

(10) Patent No.: US 9,446,419 B2
(45) Date of Patent: Sep. 20, 2016

(54) ROTARY SWITCH OUTLET MECHANISM

(75) Inventors: Huasong Zhou, Xiamen (CN); Fuli Guo, Xiamen (CN); Haisong Peng, Xiamen (CN); Jianmin Chen, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 723 days.

(21) Appl. No.: 13/816,932

(22) PCT Filed: Aug. 19, 2011

(86) PCT No.: PCT/CN2011/078633

§ 371 (c)(1),
(2), (4) Date: Feb. 13, 2013

(87) PCT Pub. No.: WO2012/025030

PCT Pub. Date: Mar. 1, 2012

(65) Prior Publication Data

US 2013/0140381 A1 Jun. 6, 2013

(30) Foreign Application Priority Data

Aug. 23, 2010 (CN) ..... 2010 1 0260227
Aug. 23, 2010 (CN) ..... 2010 2 0501563 U

(51) Int. Cl.
*B05B 1/16* (2006.01)
*B05B 1/18* (2006.01)

(52) U.S. Cl.
CPC ..... *B05B 1/16* (2013.01); *B05B 1/1654* (2013.01); *B05B 1/18* (2013.01)

(58) Field of Classification Search
CPC ..... B05B 1/16; B05B 1/1627; B05B 1/1636; B05B 1/1645; B05B 1/1654; B05B 1/18
See application file for complete search history.

(56) References Cited

U.S. PATENT DOCUMENTS

| | | | | | |
|---|---|---|---|---|---|
| 4,173,325 | A | * | 11/1979 | Petrovic | 248/81 |
| 4,303,201 | A | * | 12/1981 | Elkins et al. | 239/381 |
| 4,588,130 | A | * | 5/1986 | Trenary et al. | 239/381 |
| 4,618,100 | A | | 10/1986 | White et al. | |
| 5,205,490 | A | * | 4/1993 | Steinhardt et al. | 239/449 |
| 5,246,169 | A | * | 9/1993 | Heimann et al. | 239/447 |
| 6,561,441 | B1 | * | 5/2003 | Hsieh | 239/525 |
| 2001/0008256 | A1 | * | 7/2001 | Marsh et al. | 239/381 |
| 2007/0272770 | A1 | | 11/2007 | Leber et al. | |

FOREIGN PATENT DOCUMENTS

| | | | |
|---|---|---|---|
| CN | 2776564 | Y | 5/2006 |
| CN | 2875273 | Y | 3/2007 |
| CN | 201316684 | Y | 9/2009 |
| CN | 201469123 | U | 5/2010 |
| CN | 101767070 | A | 7/2010 |
| CN | 101940986 | A | 1/2011 |
| CN | 201913012 | U | 8/2011 |

* cited by examiner

*Primary Examiner* — Ryan Reis
(74) *Attorney, Agent, or Firm* — Rabin & Berdo, P.C.

(57) ABSTRACT

The present invention discloses a rotary switch outlet mechanism, it comprises a fixed unit, a switch unit and two outlet terminals, the fixed unit is provided with an inlet that is communicated with the water resource ever-lasting and a second outlet, the first outlet terminal is connected to the fixed unit in a rotating manner and is provided with a first outlet, and the second outlet terminal is communicated with the second outlet, and the first outlet terminal is linked to the switch unit and is provided with two locating position with the fixed unit, water comes out of the first outlet terminal when it is at the first position, water comes out of the second outlet terminal when it is at the second position. The present rotary switch outlet mechanism achieves simple structure, bigger operating surface, easier assembly, multiple functions and more convenient and faster switching process.

14 Claims, 9 Drawing Sheets

ROTARY SWITCH OUTLET MECHANISM

FIELD OF THE INVENTION

The present invention relates to bathroom field, more particular to a rotary switch outlet mechanism.

BACKGROUND OF THE INVENTION

The shower auto switch device (utility model, Chinese application number CN200520080271.9) and the vertical rotary switch device (utility model, Chinese application number CN200820146238.5) both disclose an switch valve for switching different outlet terminals, wherein different outlets are arranged to respectively communicated with different outlet terminals (such as head shower, the handheld shower and etc.), although the said switch valve are able to switch waterways, the structure is complicated, and a switch unit is needed to be arranged in the body, and a operating unit is also arranged out of the body to achieve switch, and different shower components are connected to the switch valve through connectors (such as tube), therefore the overall structure is complicated, and the manufacture procedure is trivial with not enough lightness and big space occupation.

To solve the problem above, the invention (American patent publication number: US20070272770) discloses a structure that the shower head is directly mounted on the switch valve, the structure is simplified, saving space, but the problem is still present: although the shower head can rotate with respect to the switch valve, only the outlet angle of the shower head is changed, the switch of different outlet terminals of the switch valve or the switch of different outlet effects of the show head cannot be achieved by rotating the shower head, the switch of outlet functions of the shower head can be achieved only by rotating the face cover or the face cover ring of the shower head with limited functions and inconvenient using.

SUMMARY OF THE INVENTION

The object of the present invention is to offer a rotary switch outlet mechanism which overcomes the defect at the prior.

The technical proposal solving the technical matter in the present invention is:

Rotary switch outlet mechanism, it comprises a fixed unit, a switch unit and two outlet terminals, the fixed unit is provided with an inlet that is communicated with a water resource and a second outlet, the first outlet terminal is connected to the fixed unit in a rotating manner and is provided with a first outlet, and the second outlet terminal is communicated with the second outlet, and the first outlet terminal is linked to the switch unit and is provided with two locating position with the fixed unit, water comes out of the first outlet terminal when it is at the first position, water comes out of the second outlet terminal when it is at the second position.

In a preferred embodiment, the switch unit is mounted in the fixed unit and comprises a first switch splice fixedly connected in the fixed unit and a second switch splice forming a synchronous rotation connection relationship with the first outlet terminal, wherein, a first through hole communicating with the inlet and a second through hole communicating with the second outlet are arranged on the first switch splice, a third through hole and a groove are arranged on the second switch splice, the first switch splice and the second switch splice are rotated between the first and the second position, the groove is not simultaneously communicated with the first and the second through hole and the first and the third through holes are communicated with the first outlet when it is at the first position, the third through hole is stagger with the first through hole and the first and the second through holes are communicated with the groove and the second outlet when it is at the second position.

In a preferred embodiment, the switch unit is a water division body mounted in the fixed unit and provided with two independent water division holes, wherein, the first water division hole penetrates the water division body and can be alternatively communicated with the inlet to the first outlet, an annular groove is opened on the outer surrounding wall of the water division body, the second water division hole is communicated with the annular groove and can be alternatively communicated with the inlet to the second outlet.

In a preferred embodiment, a spring and a leather cup are coupling with each other and arranged in the fixed unit and above the first water channel.

In a preferred embodiment, the entrances of the first water division hole and the second water division hole are located in the same circle of the upper end face of the water division body, the first water division hole comprises a straight hole segment and a oblique hole segment.

In a preferred embodiment, the first outlet terminal comprises a rotary body and an operating body fixedly connected to the rotary body, and the rotary body is arranged in the fixed unit, and a first water channel is arranged in the rotary body, and the operating body is mounted out of the fixed unit in a rotating manner.

In a preferred embodiment, the rotary body is connected to the second switch splice, and a first water channel is arranged in the rotary body, and the water channel is aligned with the first through hole to respectively communicate the inlet and the first outlet when it is at the first position.

In a preferred embodiment, a first water channel is arranged in the rotary body, the inlet is sealed by the rotary body when it is at the second position.

In a preferred embodiment, the first switch splice and the second switch splice are connected to each other at their end faces, the second switch splice is between the rotary body and the first switch splice, and the rotary body is connected to the second switch splice through buckles.

In a preferred embodiment, the first through hole and the second through hole of the first switch splice are configured in annular array.

In a preferred embodiment, the minimum central angle between the first through hole and the second through hole of the first switch splice is smaller than the central angle of the groove of the second switch splice.

In a preferred embodiment, a spoon-shaped second water channel is formed among the inlet, the first through hole, the groove, the second through hole and the second outlet when it is at the second position, and the second outlet is at the handle part of the spoon.

Compared with the technical proposal at the prior, the benefits of the present invention are:

1 the switch unit and the outlet terminals are coupling with each other, the operating body of the rotary unit is a first outlet terminal, the users just need to rotate the first outlet terminal, then the waterway switch is achieved, the operating surface is bigger, and the structure of the switch outlet mechanism is simplified, the function is diversified, and the switch is more convenient;

2 the switch unit comprises a first switch splice fixedly connected to the fixed unit and a second switch splice forming a synchronous rotation connection relationship with the first outlet terminal, two through holes are opened on the first switch splice, and a through hole and a groove are opened on the second switch splice, the two switch splices is coupling with each other to switch waterways, the axial switch is achieved with compact structure, good tightness and stable and reliable switch;

3 the switch unit is also a water division body with two independent water division holes that can be alternatively communicated with the first or the second outlet along with the rotation of the outlet terminal, the switch is fast and stable, and the structure is more simple;

4 because the outlet terminal comprises a rotary body and a operating body, and the rotary body is provided with a first water channel, the rotary body and the second switch splice are driven to rotate to make the first switch splice and the second switch splice couple with each other at their end faces when users rotate the operating body;

5 the first outlet terminal comprises a rotary body and a operating body, and the rotary body is provided with a first water channel, the rotary body and the water division body is driven to rotate to communicate the first water division hole with the first water channel or to communicate the second water division hole with the second outlet through the annular groove when users rotate the operating body;

6 a first water channel is arranged in the rotary body, the inlet can be communicated with the first outlet when it is at the first or the third position, and the water channel is blocked when it is at the two or the forth position, the structure is skillfully designed;

7 the first through hole and the second through hole of the first switch splice are configured in annular array, it is more beautiful and is easier to produce;

8 the rotary body is connected to the second switch splice through buckles, so the connection is stable during rotating process;

9 the central angle between the first through hole and the second through hole of the first switch splice is smaller than the central angle of the groove of the second switch splice, therefore the first and the second through holes can be simultaneously communicated with the groove but to be stagger when it is at the second position, a water channel communicating the inlet and the second outlet is formed;

10 a spoon-shaped second water channel is formed among the inlet, the first through hole, the groove, the second through hole and the second outlet when it is at the second position, and the second outlet is at the handle part of the spoon, therefore the first and the second outlet are in different plane of the fixed unit with high space utilization rate, and mutual interference is avoid.

REFERENCE SIGN

Figure 1:
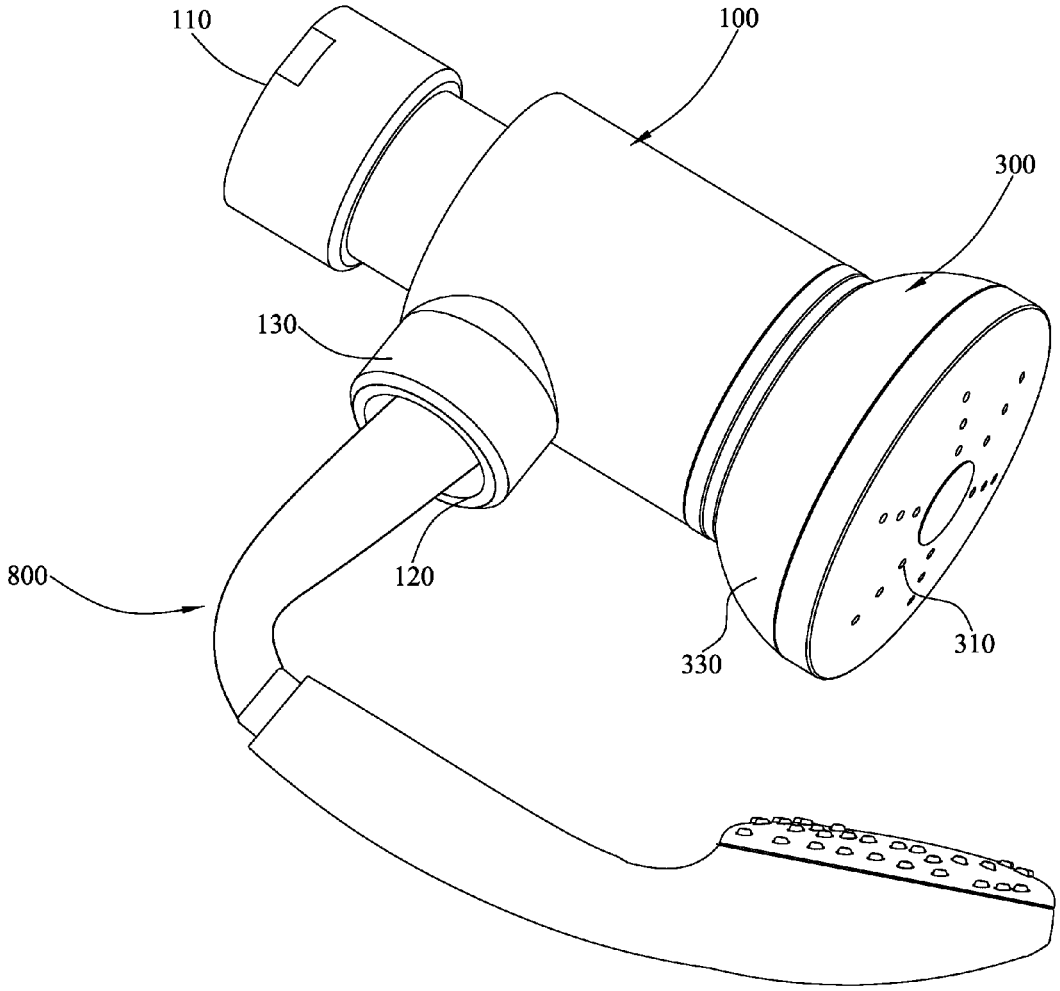
FIG. 1 shows the solid abridged general view of the rotary switch outlet mechanism in the embodiment 1.

Fixed unit—100; inlet—110; second outlet—120; connector—130; switch unit—200; first switch slice—210; first through hole—211; second through hole—212; second switch slice—220; third through hole—221; groove—222; catching groove—223; second water channel—224; first water division hole—230; second water division hole—240; annular groove—250; first outlet terminal—300; first outlet—310; rotary body—320; first water channel—321; fastening—322; operating body—330; spring—400; packing leather cup—500; sealing ring—600, 700.

DESCRIPTION OF THE PREFERRED EMBODIMENTS

With the following description of the drawings and specific embodiments, the invention shall be further described in details.

Embodiment 1

According to FIG. 1 to 6, the rotary switch outlet mechanism offered by the embodiment 1 of the present invention is shown.

The rotary switch outlet mechanism mainly comprises a fixed unit 100, a switch unit 200, a first outlet terminal 300 and a second outlet terminal 800.

FIG. 1 shows the solid abridged general view of the rotary switch outlet mechanism, from the outside, the fixed unit 100 is provided with an inlet 110 that is communicated with a water resource, and a connector 130 is arranged at the side of the fixed unit, which is provided with a second outlet 120 that is alternatively communicated with the inlet 110 and can be connected to the handheld shower or spray gun through tube to form the second outlet terminal 800; the first outlet terminal 300 is provided with a first outlet 310 that is alternatively communicated with the inlet 110, the operating body 330 is a head shower assembly that is mounted to the fixed unit 100 in a rotating manner.

Figure 2:
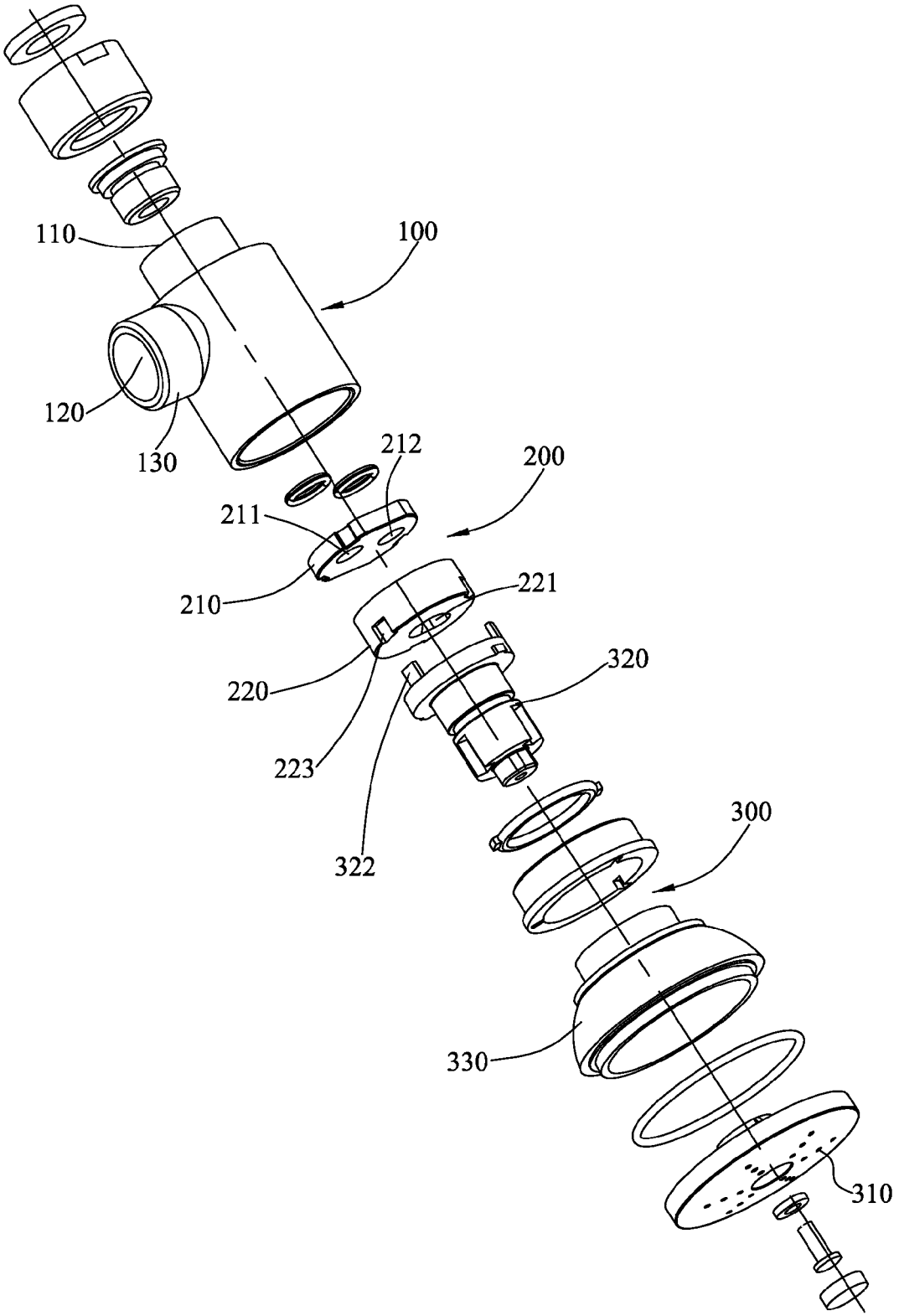
FIG. 2 shows the solid exploded view of the rotary switch outlet mechanism in the embodiment 1.
Figure 3:
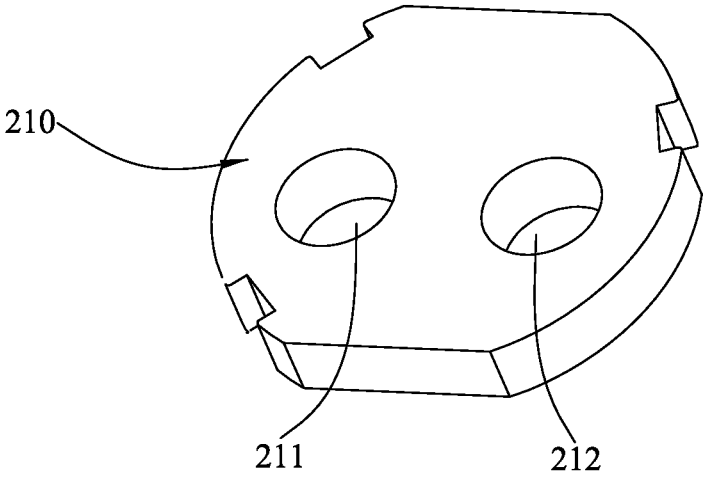
FIG. 3 shows the solid abridged general view of the first switch slice in the embodiment 1.
Figure 4:
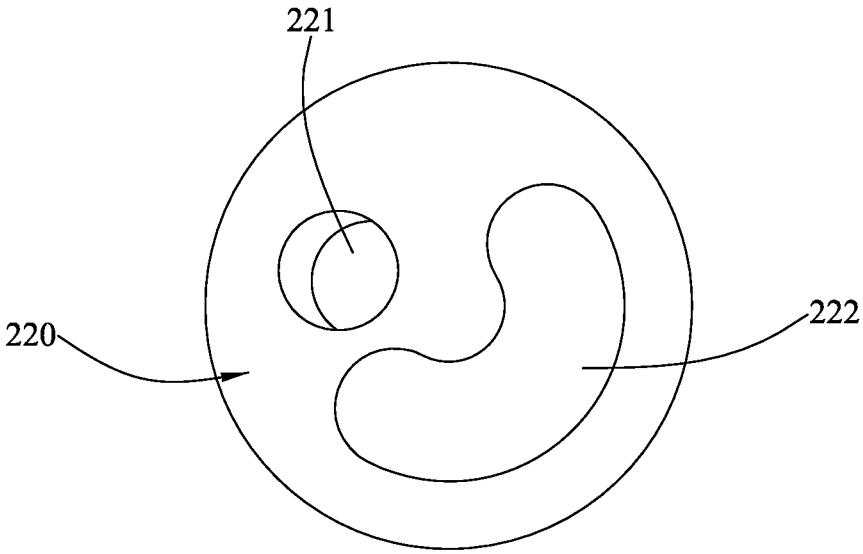
FIG. 4 shows the solid abridged general view of the second switch slice in the embodiment 1.

FIG. 2 shows the solid exploded view of the rotary switch outlet mechanism, wherein, the switch unit 200 is arranged in the fixed body 100, which comprises a first switch splice 210 and a second switch splice 220, and according to FIGS. 3 and 4, the first switch splice 210 is fixedly connected in the fixed unit, and a first through hole 211 that is communicated with the inlet 110 and a second through hole 212 that is communicated with the second outlet are opened on the first switch splice 210; the second switch splice 220 is coupling with the first switch splice 210 at their end faces and is linked with the rotary unit 300, and a through hole 221 and a groove 222 are opened on the second switch splice 220.

The first outlet terminal 300 comprises a first outlet 310, a rotary body 320 and an operating body 330, wherein, the inner cavity of the rotary body 320 is arranged to be the first water channel 321, which can be mounted in the fixed unit 100 in a rotating manner, and the operating body 330 exposes out of the fixed unit 100 for user's rotating; the rotary body 320 is fixedly connected to the operating body 330, the rotary body 320 is linked to the second switch splice 220 through the coupling of the catching grooves 223 arranged on the second switch splice 220 and the fastenings 322 arranged on the corresponding position of the rotary body 320, therefore the relative position among the first through hole 211, the second through hole 212, the third through hole 221 and the groove 120 is changed by rotating the second switch splice 220 driven by the rotary body 320 when the operating body 330 rotates.

The second outlet terminal 800 is composed of the second outlet 120 and the connector 130.

As shown in FIGS. 3 and 4, the first through hole 211 and the second through hole 212 on the first switch splice 210 are configured in annular array, the central angle is set to be smaller than the central angle of the groove 222 of the second switch splice 220, in this matter, when the second switch splice 220 is rotated to the second position, the first through hole 211 and the second through hole 212 will keep being communicated with the groove 222 when the second switch splice 220 is rotated to the second position and will not go so far as to stagger to not form water channel, the staggering means one of the first through hole 211 and the second through hole 212 is stagger with the groove 222, or the first through hole 211 and the second through hole 212 are stagger with the groove 222 simultaneously.

Figure 5:
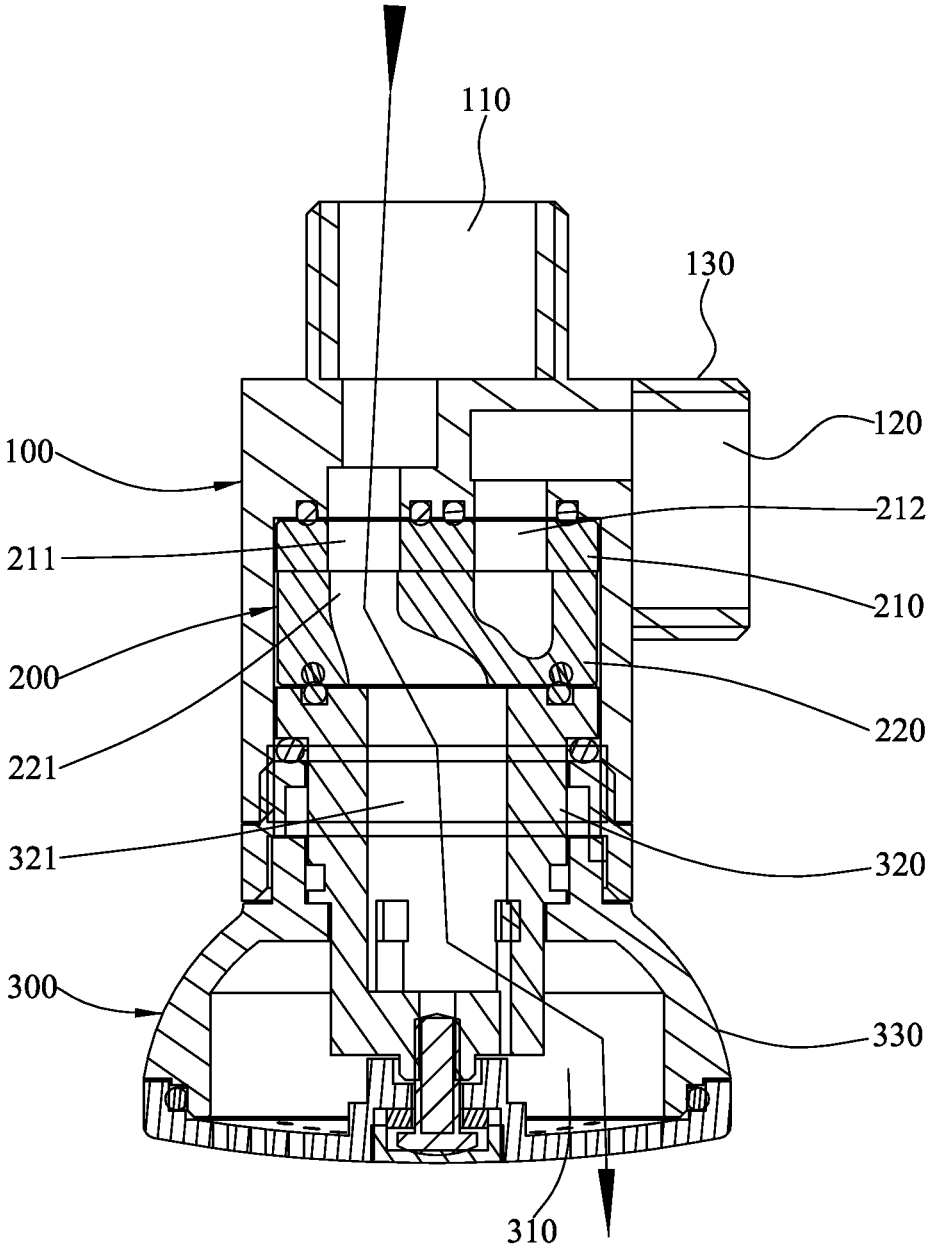
FIG. 5 shows the sectional view of the rotary switch outlet mechanism in the embodiment 1, water comes out of the first outlet terminal.

FIG. 5 shows the sectional view of the rotary switch outlet mechanism when water comes out of the first outlet terminal 300, namely it is at the first position of the relative rotation of the first switch splice 210 and the second switch splice 220, the operating body 330 is rotated after the water resource is opened, namely the body of the head shower, so that the third through hole 221 on the second switch splice 220 and the first water channel 321 of the rotary body 320 are aligned to the first through hole 211 of the first switch splice 210, and the groove 222 of the second switch splice 220 is not simultaneously communicated with the first through hole 211 and the second through hole 212, therefore water will enter the inlet 110, the first through hole 211 and the third through hole 221 in turns, then enters the first water channel 321 and flows out of the first outlet 310, and water comes out of the head shower but the second outlet channel at this moment.

Figure 6:
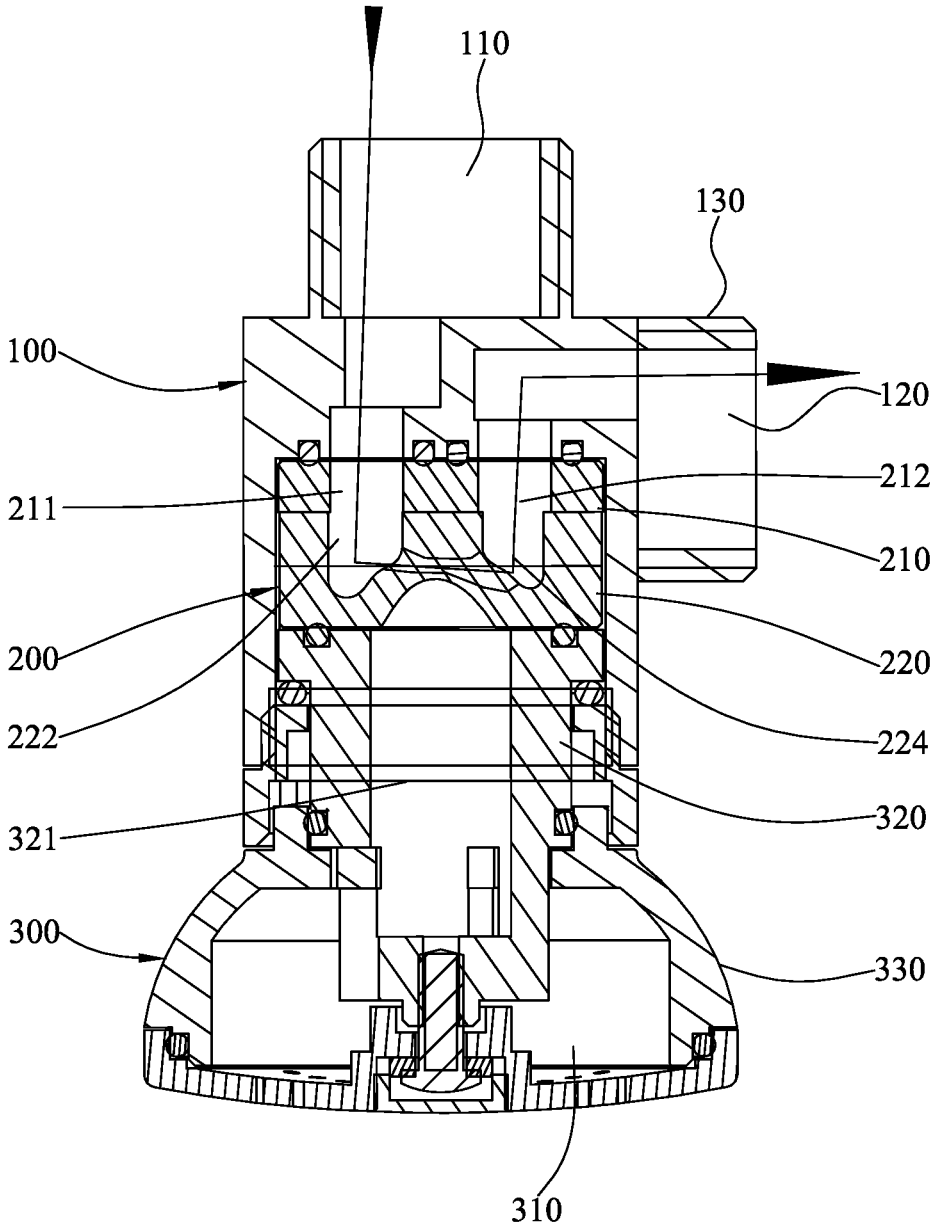
FIG. 6 shows the sectional view of the rotary switch outlet mechanism in the embodiment 1, water comes out of the second outlet terminal.
Figure 7:
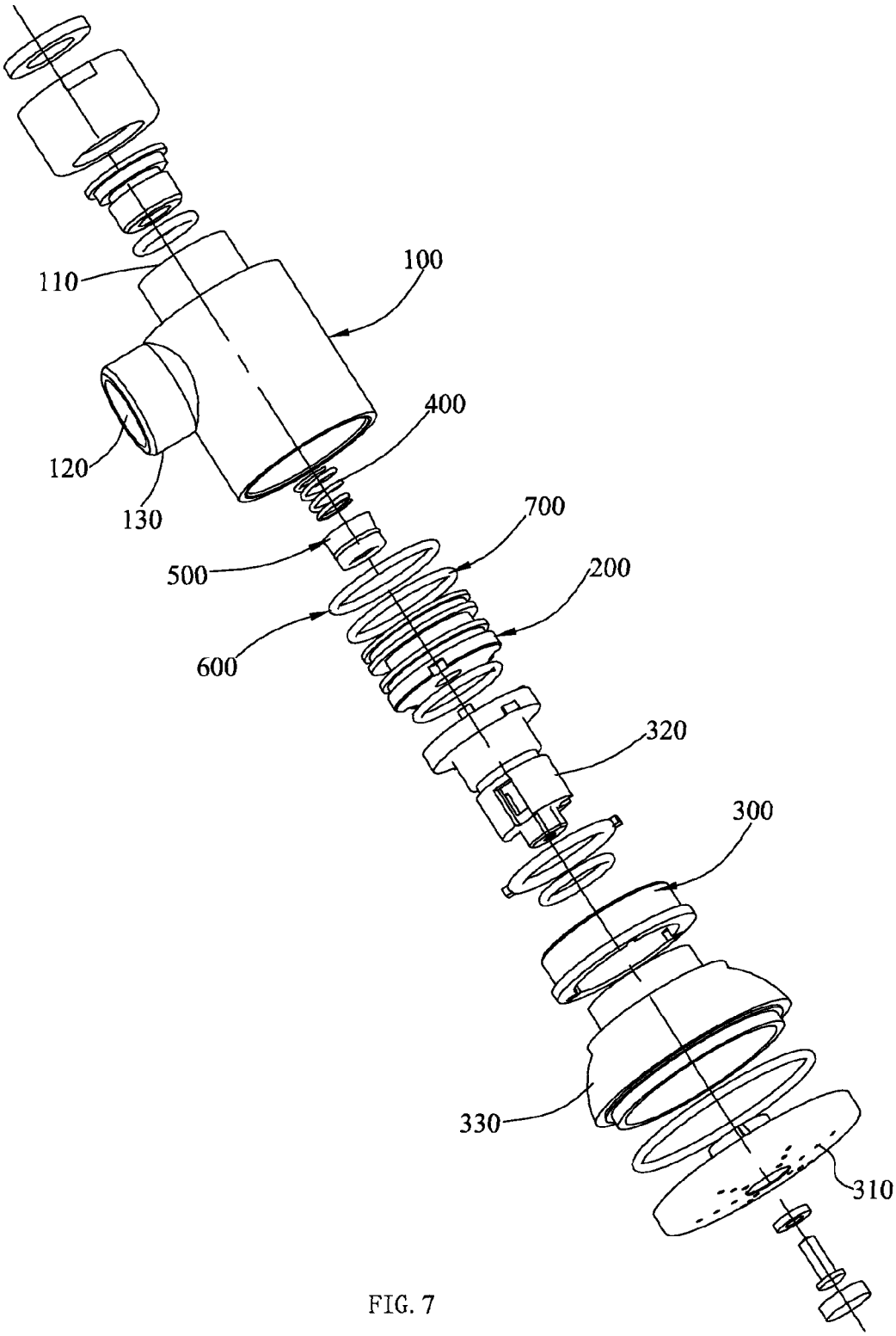
FIG. 7 shows the solid abridged general view of the rotary switch outlet mechanism in the embodiment 2.

FIG. 6 shows the sectional view of the rotary switch outlet mechanism when water comes out of the second outlet terminal 800, namely it is at the second position of the relative rotation of the first switch splice 210 and the second switch splice 220, the operating body 330 is continuously rotated, so that the third through hole 221 on the second switch splice 220 and the first water channel 321 of the rotary body 320 are staggered to the first through hole 211 of the first switch splice 210, and the groove 222 of the second switch splice 220 simultaneously communicates with the first through hole 211 and the second through hole 212, because the second through hole 212 communicates with the second outlet 120, a spoon-shaped second water channel 224 is formed among the inlet 110, the first through hole 211, groove 222, the second through hole 212 and the second outlet 120 after the water resource is opened, wherein, the second outlet 120 is at the handle part of the spoon, and water flows along the second water channel 224, and eventually flows out of the second outlet 120, no water comes out of the first outlet terminal 300 at this moment.

The operating body 330 is rotated, and that cycle repeats, then different waterway switch functions can be achieved.

Embodiment 2

According to FIG. 7 to 10, the rotary switch outlet mechanism offered by the embodiment 2 of the present invention is shown.

Figure 8:
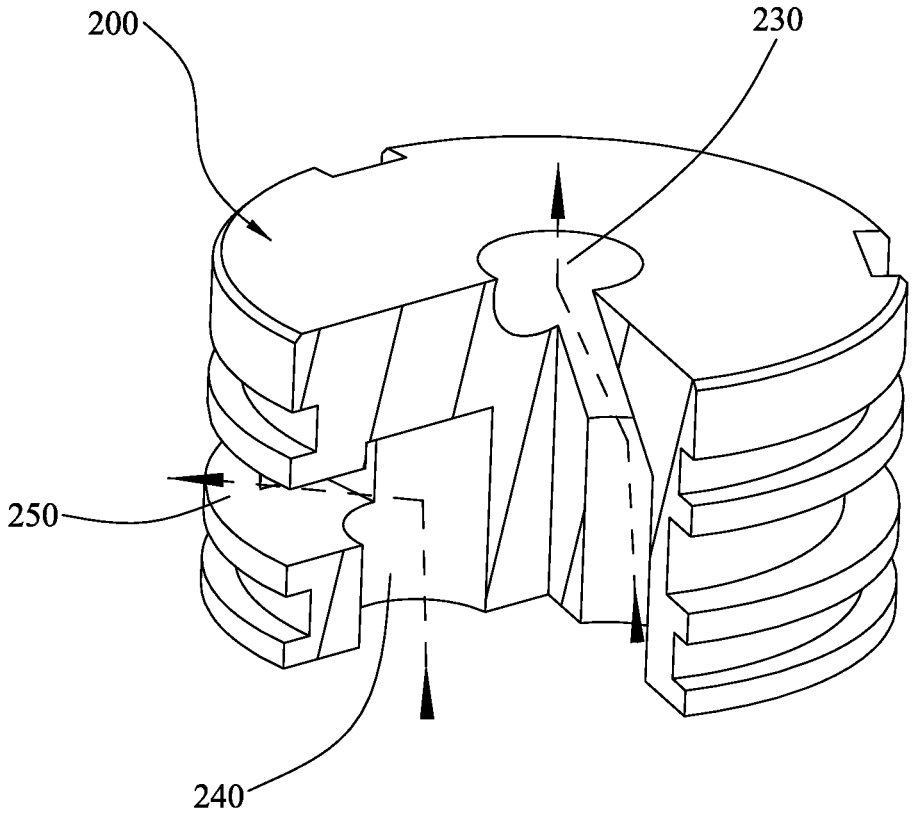
FIG. 8 shows the internal structure view of the water division body in the embodiment 2.

The differences of the present rotary switch outlet mechanism from the embodiment is that the switch unit 200 is a water division body, as shown in FIG. 8, the water division body 200 is provided with two water division holes, wherein, the first water division hole 230 that is a penetrating through hole can alternatively be communicated with the inlet 110 and the first water channel 321; the second water division hole 240 that is a blind hole opened on the water division body 200 is communicated with an annular groove 250 of the water division body 200; the entrances of the first water division hole 230 and the second water division hole 240 are located in the same circle of the upper end face of the water division body; the first water division hole 230 comprises a straight hole segment and a oblique hole segment.

A spring 400 and a leather cup 500 are coupled with each other and arranged in the fixed unit and above the first water channel 321, two sealing rings 600 and 700 are sleeved to the outer surrounding surface of the water division body 200 respectively to achieve better sealing effect.

Figure 9:
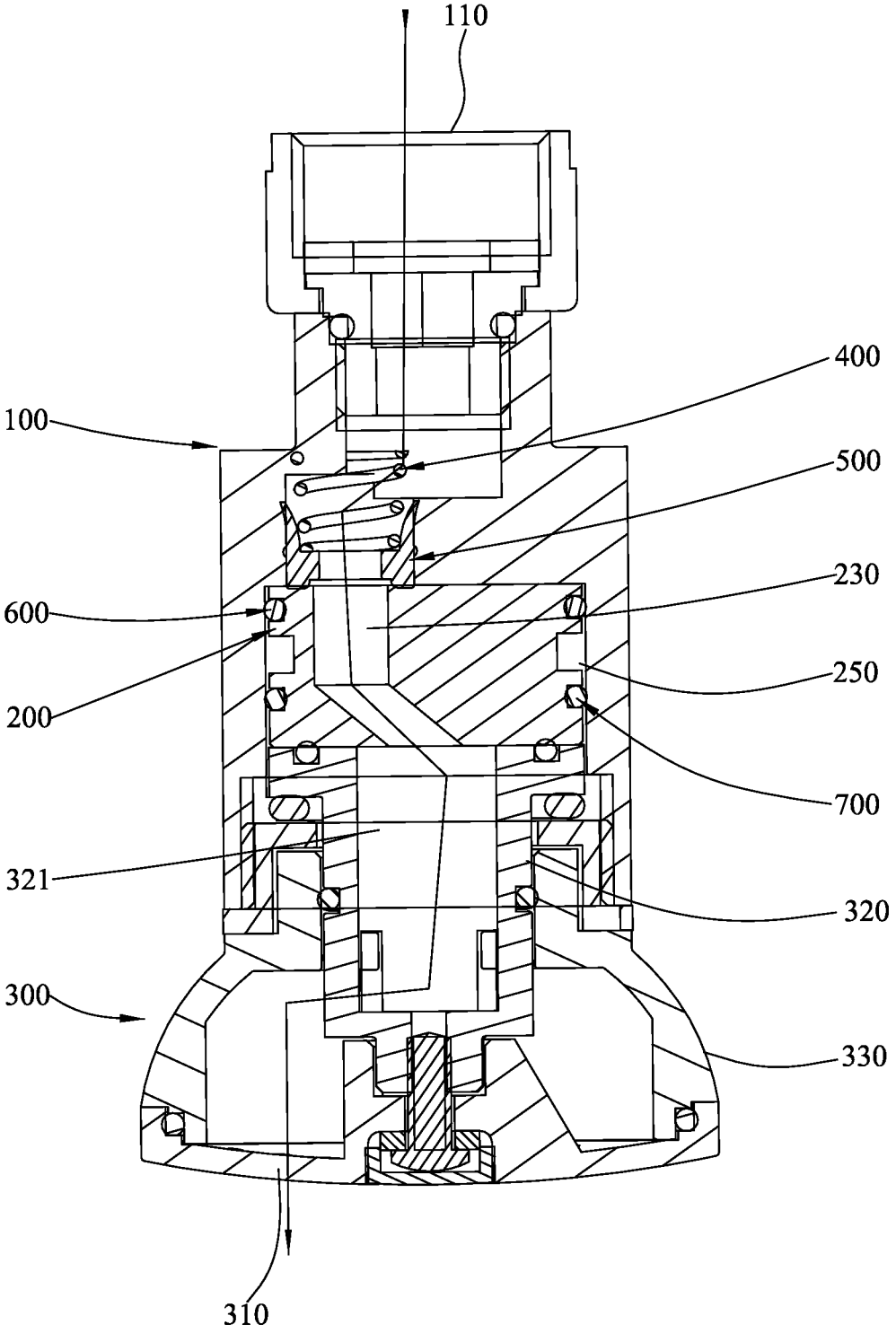
FIG. 9 shows the sectional view of the rotary switch outlet mechanism in the embodiment 2, water comes out of the first outlet terminal.

FIG. 9 shows the abridged general view of the present embodiment, at this moment water comes out of the first outlet terminal 300, namely at the first position.

The operating body 330 (namely the body of the head shower) is rotated after the water resource is opened, so that the first water division hole 230 of the water division body 200 is aligned with the first water channel 321 of the rotary body 320, and the second water division hole 240 is stagger with the inlet 110, therefore water will enter the inlet 110 and the first water division hole 230 in turns, then enters the first water channel 321 and flows out of the first outlet 310, and water comes out of the head shower but the second outlet channel at this moment.

Figure 10:
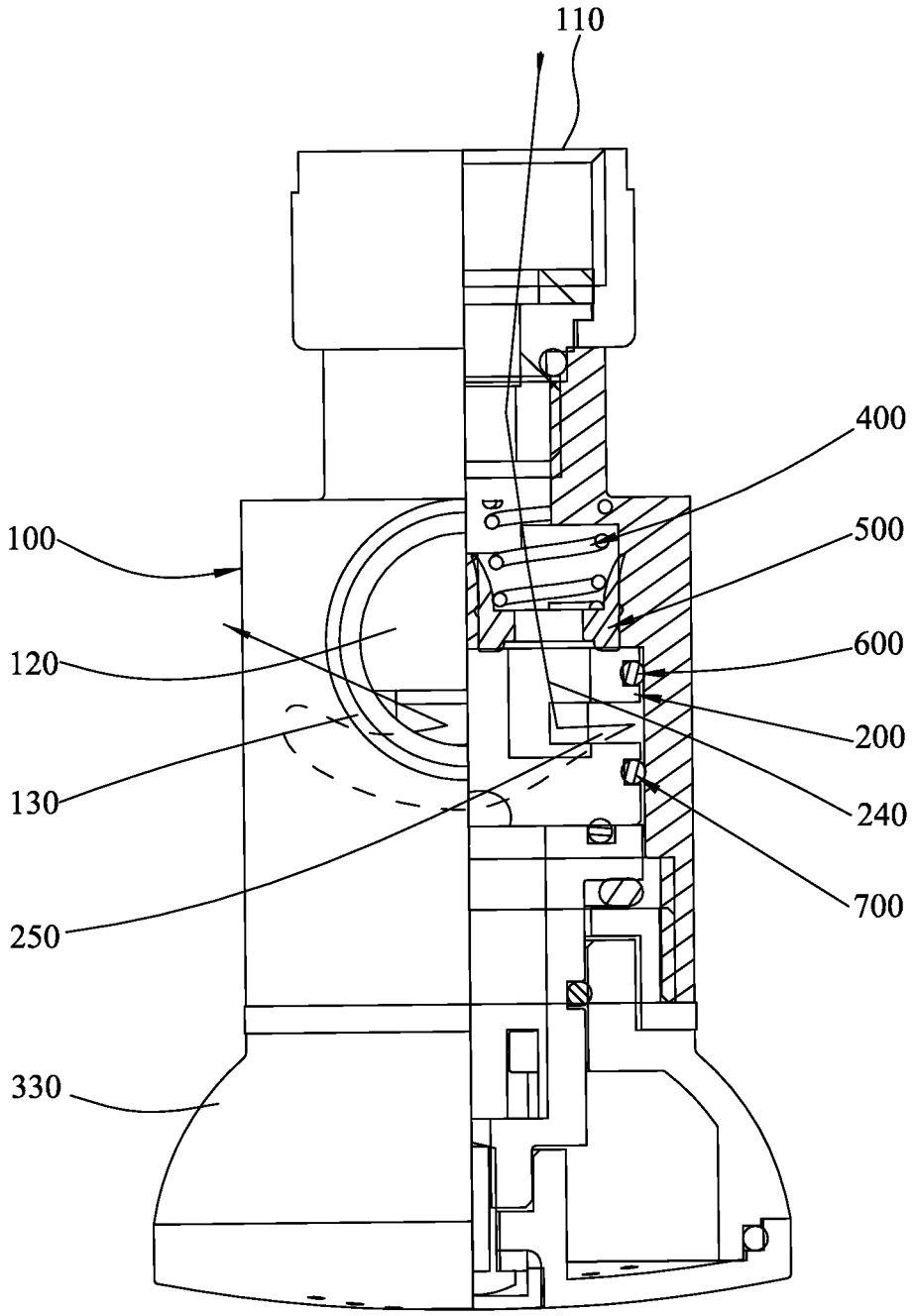
FIG. 10 shows the sectional view of the rotary switch outlet mechanism in the embodiment 2, water comes out of the second outlet terminal.

FIG. 10 shows the abridged general view of the present embodiment, at this moment water comes out of the second outlet terminal, namely at the second position.

The operating body 330 is continuously rotated, so that the first water division hole 230 of the water division body is stagger with the inlet 110, and the second water division hole 240 is aligned with the inlet 110, therefore water flows into the inlet 110 and the second water division hole 240 in turns and along with the annular groove 250 of the water division body 200 after the water resource is opened, and eventually flows out of the second outlet 120, no water comes out of the first outlet terminal 300 at this moment.

The operating body 330 is rotated, and that cycle repeats, then different waterway switch functions can be achieved.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

The rotary switch outlet mechanism in the present invention, its fixed unit, switch unit and outlet terminals couples with each other, rotate the operating body of the unit (the first outlet terminal), the users just need to directly rotate the first outlet terminal to switch waterway with more simple structure, bigger operating surface, easier assembly multiple functions and more convenient and faster switching process.

What is claimed is:

1. Rotary switch outlet mechanism, comprising:

a fixed unit, a switch unit and two outlet terminals, including a first outlet terminal flexibly attached to the fixed unit, and a second outlet terminal rigidly attached to the fixed unit, wherein:

the fixed unit is provided with an inlet that communicates with a water resource and a second outlet, the first outlet terminal is connected to the fixed unit in a rotating manner and is provided with a first outlet, and the second outlet terminal communicates with the second outlet, and the first outlet terminal is linked to the switch unit and is provided with two locating positions with the fixed unit, wherein water comes out of the first outlet terminal when the switch unit is set to a first position, water comes out of the second outlet terminal when the switch unit is set to a second position, the switch unit is a water division body mounted in the fixed unit and provided with two independent water division holes, a first water division hole penetrates the water division body and can alternatively communicate with the inlet to the first outlet, an annular groove is opened on an outer surrounding wall of the water division body, a second water division hole communicates with the annular groove and can alternatively communicate with the inlet to the second outlet, and a spring and a leather cup are coupled with each other and arranged in the fixed unit above a first water channel.

2. Rotary switch outlet mechanism according to claim 1, wherein, the switch unit is mounted in the fixed unit and comprises a first switch splice fixedly connected in the fixed unit and a second switch splice forming a synchronous rotation connection relationship with the first outlet terminal, wherein, a first through hole communicating with the inlet and a second through hole communicating with the second outlet are arranged on the first switch splice, a third through hole and a groove are arranged on the second switch splice, the first switch splice and the second switch splice are rotated between the first and the second position, the groove does not simultaneously communicate with the first and the second through hole and the first and the third through holes communicate with the first outlet when it is at the first position, the third through hole is staggered with the first through hole and the first and the second through holes communicate with the groove and the second outlet when it is at the second position.

3. Rotary switch outlet mechanism according to claim 2, wherein, the first outlet terminal comprises a rotary body and an operating body fixedly connected to the rotary body, the rotary body is arranged in the fixed unit, a first water channel is arranged in the rotary body, and the operating body is mounted out of the fixed unit in a rotating manner.

4. Rotary switch outlet mechanism according to claim 3, wherein, the rotary body is connected to the second switch splice, the first water channel is arranged in the rotary body, and the water channel is aligned with the first through hole to respectively communicate the inlet and the first outlet when it is at the first position.

5. Rotary switch outlet mechanism according to claim 3, wherein, the first water channel is arranged in the rotary body, and the inlet is sealed by the rotary body when it is at the second position.

6. Rotary switch outlet mechanism according to claim 2, wherein, the first through hole and the second through hole of the first switch splice are configured in annular array.

7. Rotary switch outlet mechanism according to claim 2, wherein, a minimum central angle between the first through hole and the second through hole of the first switch splice is smaller than a central angle of the groove of the second switch splice.

8. Rotary switch outlet mechanism according to claim 2, wherein, a spoon-shaped second water channel is formed among the inlet, the first through hole, the groove, the second through hole and the second outlet when it is at the second position, and the second outlet is at the handle part of the spoon.

9. Rotary switch outlet mechanism according to claim 1, wherein, the first outlet terminal comprises a rotary body and an operating body fixedly connected to the rotary body, the rotary body is arranged in the fixed unit, a first water channel is arranged in the rotary body, and the operating body is mounted out of the fixed unit in a rotating manner.

10. Rotary switch outlet mechanism according to claim 9, wherein, the rotary body is connected to the second switch splice, the first water channel is arranged in the rotary body, and the water channel is aligned with the first through hole to respectively communicate between the inlet and the first outlet when it is at the first position.

11. Rotary switch outlet mechanism according to claim 9, wherein, the first water channel is arranged in the rotary body, and the inlet is sealed by the rotary body when it is at the second position.

12. Rotary switch outlet mechanism according to claim 1, wherein, entrances of the first water division hole and the second water division hole are located in a same circle as an upper end face of the water division body, and the first water division hole comprises a straight hole segment and an oblique hole segment.

13. Rotary switch outlet mechanism according to claim 3, wherein, the first switch splice and the second switch splice are connected to each other at their end faces, the second switch splice is between the rotary body and the first switch splice, and the rotary body is connected to the second switch splice through buckles.

14. Rotary switch outlet mechanism according to claim 9, wherein, the first switch splice and the second switch splice are connected to each other at their end faces, the second switch splice is between the rotary body and the first switch splice, and the rotary body is connected to the second switch splice through buckles.

* * * * *